US009348267B2

(12) United States Patent
Ai

(10) Patent No.: US 9,348,267 B2
(45) Date of Patent: May 24, 2016

(54) IMAGE FORMING APPARATUS

(71) Applicant: CANON KABUSHIKI KAISHA, Tokyo (JP)

(72) Inventor: Ryuta Ai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,332

(22) Filed: May 20, 2015

(65) Prior Publication Data

US 2015/0338785 A1 Nov. 26, 2015

(30) Foreign Application Priority Data

May 21, 2014 (JP) ..... 2014-104900

(51) Int. Cl.
*G03G 15/16* (2006.01)

(52) U.S. Cl.
CPC ..... *G03G 15/161* (2013.01)

(58) Field of Classification Search
None
See application file for complete search history.

(56) References Cited

U.S. PATENT DOCUMENTS

| | | | | |
|---|---|---|---|---|
| 7,251,433 | B2 | 7/2007 | Ai et al. | |
| 7,668,478 | B2 | 2/2010 | Ai | |
| 2012/0008973 | A1 * | 1/2012 | Sakakibara et al. | 399/71 |
| 2014/0093259 | A1 | 4/2014 | Shiraki | |

FOREIGN PATENT DOCUMENTS

| | | | |
|---|---|---|---|
| JP | 07-334018 | A | 12/1995 |
| JP | 2002-207403 | A | 7/2002 |
| JP | 2007-086201 | A | 4/2007 |
| JP | 2014-071366 | A | 4/2014 |

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes: an intermediary transfer member; an image forming unit; a transfer member; a cleaning member; and a setting portion for setting an absolute value of the first cleaning voltage applied to the cleaning member when a region of the intermediary transfer member, passed through the transfer portion where a higher transfer voltage is applied to the transfer member during passing of the recording material through the transfer portion, passes through the cleaning portion and for setting an absolute value of the second cleaning voltage applied to the cleaning member when a region of the intermediary transfer member, passed through the transfer portion where a lower transfer voltage is applied to the transfer member during passing of the recording material through the transfer portion, passes through the cleaning portion. The absolute value of the second cleaning voltage is higher than that of the first cleaning voltage.

11 Claims, 9 Drawing Sheets

IMAGE FORMING APPARATUS

FIELD OF THE INVENTION AND RELATED ART

The present invention relates to an image forming apparatus including an intermediary transfer member.

An image forming apparatus in which a transfer portion where a toner image is to be transferred onto a recording material is formed by bringing a transfer roller into contact with an intermediary transfer belt and then the toner image is transferred from the intermediary transfer belt onto the recording material by applying a voltage of a polarity opposite to a charge polarity of a toner to the transfer roller has been used widely. On the intermediary transfer belt passed through the transfer portion, transfer residual toner which is not transferred onto the recording material at the transfer portion is deposited, and therefore at a position downstream of the transfer portion with respect to a movement direction of the intermediary transfer belt, a belt cleaning device is provided.

In an image forming apparatus disclosed in Japanese Laid-Open Patent Application 2002-207403, an electroconductive fur brush is contacted to the intermediary transfer belt and is rotated, and then the transfer residual toner on the intermediary transfer belt is electrostatically transferred onto and collected by the fur brush by applying the voltage of the polarity opposite to the charge polarity of the toner to the fur brush.

Japanese Laid-Open Patent Application Hei 7-334018 discloses that in an image forming apparatus in which the transfer portion where the toner image is to be transferred onto the recording material is formed by bringing the transfer roller into contact with a photosensitive drum, the recording material vibrates to cause improper transfer when a trailing end portion of the recording material passes through the transfer portion. In Japanese Laid-Open Patent Application Hei 7-334018, in order to suppress such an improper transfer, the voltage applied to the transfer portion is lowered during the passing of the trailing end portion of the recording material through the transfer portion.

Therefore, such an experiment that in the image forming apparatus in which the fur brush is contacted to the intermediary transfer belt to electrostatically clean the intermediary transfer belt, a transfer voltage applied to the transfer portion when the trailing end portion of the recording material passes through the transfer portion is lowered to suppress the improper transfer in the trailing end portion of the recording material was conducted. As a result, it turned out that a certain suppressing effect on the improper transfer was achieved, while image contamination was liable to generate on a fixed image.

SUMMARY OF THE INVENTION

According to an aspect of the present invention, there is provided an image forming apparatus comprising: a movable intermediary transfer member; an image forming unit for forming a toner image on the intermediary transfer member; a transfer member, to which a first transfer voltage and a second transfer voltage are applicable, for transferring the toner image from the intermediary transfer member onto a recording material passing through a transfer portion formed between itself and the intermediary transfer member; a cleaning member, to which a first cleaning voltage and a second cleaning voltage are applicable, for removing a toner on the intermediary transfer member passing through a cleaning portion formed between itself and the intermediary transfer member; and a setting portion for setting an absolute value of the first cleaning voltage applied to the cleaning member when a region of the intermediary transfer member, passed through the transfer portion where the first transfer voltage is applied to the transfer member during passing of the recording material through the transfer portion, passes through the cleaning portion and for setting an absolute value of the second cleaning voltage applied to the cleaning member when a region of the intermediary transfer member, passed through the transfer portion where the second transfer voltage lower in absolute value than the first transfer voltage is applied to the transfer member during passing of the recording material through the transfer portion, passes through the cleaning portion, wherein the absolute value of the second cleaning voltage is higher than the absolute value of the first cleaning voltage.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail with reference to the drawings.

<Embodiment 1>

(Image Forming Apparatus)

Figure 1:
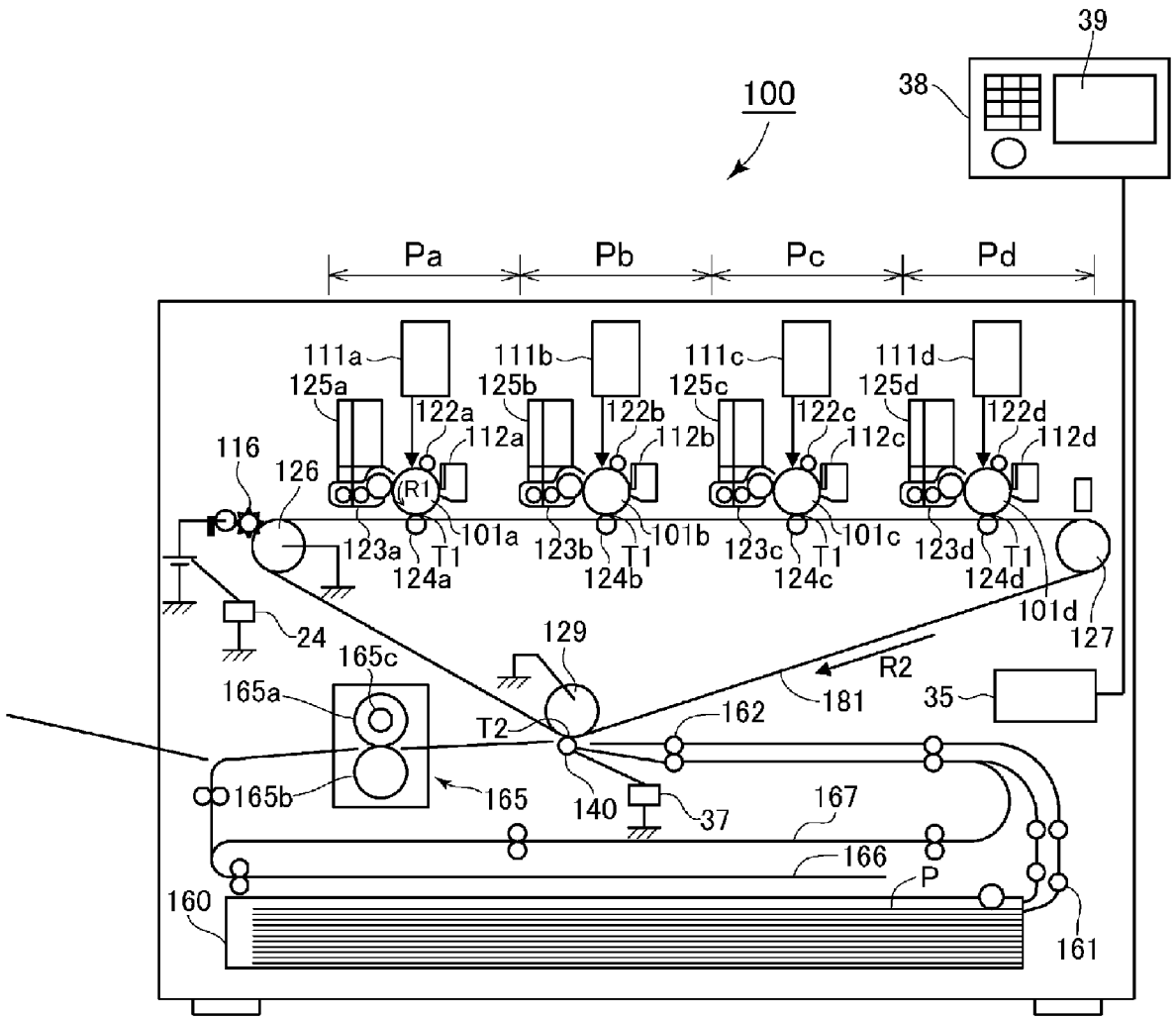
FIG. 1 is an illustration of a structure of an image forming apparatus.

FIG. 1 is an illustration of a structure of an image forming apparatus 100. As shown in FIG. 1, the image forming apparatus 100 is an intermediary transfer-type full-color printer of a tandem type in which image forming portions Pa, Pb, Pc and Pd are provided and arranged along an intermediary transfer belt 181.

At the image forming portion Pa, a yellow toner image is formed on a photosensitive drum 101*a* and is transferred onto the intermediary transfer belt 181. At the image forming portion Pb, a magenta toner image is formed on a photosensitive drum 101*b* and is transferred onto the intermediary transfer belt 181. At the image forming portions Pc and Pd, a cyan toner image and a black toner image are formed on photosensitive drums 101*c* and 101*d*, respectively, and are transferred onto the intermediary transfer belt 181.

The four color toner images transferred on the intermediary transfer belt 181 are fed to a secondary transfer position T2, and are secondary-transferred onto a recording material P. The recording material P is fed from a recording material cassette 160 and is separated one by one by a separating roller pair 161, and then is sent to a registration roller pair 162. The registration roller pair 162 sends the recording material P to the secondary transfer portion T2 while timing the recording material P to the toner images on the intermediary transfer belt 181.

A secondary transfer roller 140 contacts the intermediary transfer belt 181 supported by a secondary transfer inner roller 129 at an inside surface of the intermediary transfer belt 181, thus forming the secondary transfer position T2. A secondary transfer voltage output position 37 applies a DC voltage to the secondary transfer roller 140, so that the toner images are secondary-transferred from the intermediary transfer belt 181 which is an example of an intermediary transfer member onto the recording material P fed through the secondary transfer portion T2.

The recording material P on which the four color toner images are secondary-transfers is curvature-separated from the intermediary transfer belt 181 at an exit of the secondary transfer portion T2 and then is sent into a fixing device 165, in which the toner images are heated and pressed and are thus fixed on the recording material P. The fixing device 165 applies predetermined pressure and heat quantity to the toner images on the recording material P at a nip formed by a fixing roller 165*a* including a heater 165*c* and a pressing roller 165*b*, thus melt-fixing the toner images on the recording material P.

(Image Forming Position)

The image forming portions Pa, Pb, Pc and Pd have substantially the same constitution except that colors of the toners used in developing devices 123*a*, 123*b*, 123*c* and 123*d* are yellow, magenta, cyan and black, respectively, which are different from each other. In the following, the image forming portion Pa will be described, and after image forming portions Pb, Pc and Pd will be omitted from redundant description.

In the image forming portion Pa, at a periphery of the photosensitive drum 101*a*, a charging device 122*a*, an exposure device 111*a*, the developing device 123*a*, a primary transfer roller 124*a* and a drum cleaning device 112*a* are provided.

The photosensitive drum 101*a* is prepared by forming a photosensitive layer on an outer peripheral surface of an aluminum cylinder of 80 mm in diameter by applying a layer of an organic photoconductor (OPC). The photosensitive drum 101*a* is rotatably supported at end positions thereof, and to one of the end positions, a driving force is transmitted from an unshown driving motor, so that the photosensitive drum 1*a* is rotated in an arrow R1 direction at a process speed of 300 mm/sec.

The charging device 122*a* electrically charges the photosensitive drum 101*a* to a uniform negative polarity potential by using a charging roller.

The exposure device 111*a* scans the surface of the photosensitive drum 101*a* with a laser beam, through a rotating mirror, generated on the basis of an image signal developed from image data into scanning lines, so that an electrostatic image for an image is written (formed) on the surface of the photosensitive drum 101*a*.

The developing device 123*a* develops the electrostatic image into the toner image by transferring a negative charged toner onto the electrostatic image on the photosensitive drum 101*a*. A developer supplying position 125*a* supplies, to the developing device 123*a* in an amount corresponding to the toner taken out from the developing device 123*a* with the image formation.

The primary transfer roller 124*a* urges the intermediary transfer belt 181 to form a primary transfer portion between the photosensitive drum 101*a* and the intermediary transfer belt 181. An unshown transfer voltage source applies a positive DC voltage to the primary transfer roller 124*a*, so that the negative toner image is transferred from the photosensitive drum 101*a* onto the intermediary transfer belt 181.

The drum cleaning device 112*a* collects transfer residual toner deposited on the surface of the photosensitive drum 101*a* by rubbing the photosensitive drum 101*a* with a cleaning blade. A belt cleaning device 116 electrostatically removes the transfer residual toner on the intermediary transfer belt 181 passing through the secondary transfer portion T2, thus subjecting the intermediary transfer belt 181 to subsequent image formation.

(Intermediary Transfer Belt)

Figure 2:
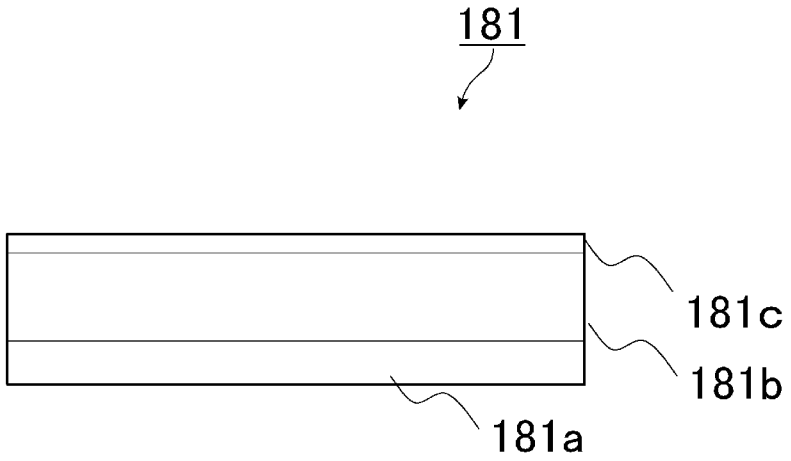
FIG. 2 is a sectional view of an intermediary transfer belt.

FIG. 2 is a sectional view of the intermediary transfer belt 181. As shown in FIG. 1, the intermediary transfer belt 181 is an endless elastic belt of 2400 mm in circumferential length. The intermediary transfer belt 181 is stretched by a driving roller 127, a tension roller 126 and a secondary transfer inner roller 129. The driving roller 127 is driven by an unshown motor to rotationally drive the intermediary transfer belt 181 in an arrow R2 direction. The tension roller 126 is urged by using springs at end positions thereof, and applies a substantially constant tension of about 20-50 N (2-5 kgf) to the intermediary transfer belt 181.

As shown in FIG. 2, the intermediary transfer belt 181 is prepared by laminating a 20-200 μm thick elastic layer 181*b* of an elastic material on a 70 μm-thick base layer 181*a* of a resin material. The surface of the elastic layer 181*b* is coated with a 5-10 μm thick surface layer 181*c* of a fluorine-containing resin material.

The resin material for the base layer 181*a* is polyimide, polycarbonate and the like. As the elastic material for the elastic layer 181*b*, it is possible to use one or two or more species of material selected from the group consisting of elastic material rubbers and elastomers, such as butyl rubber, fluorine-containing rubber, acrylic rubber, EPDM and NBR. Elastic materials other than these materials may also be used. The surface layer 181*c* can use a resin material such as polyurethane, polyester, epoxy resin and fluorine-containing resin. The surface layer decreases a depositing force of the toner on the surface of the intermediary transfer belt 181, thus facilitating the transfer of the toner onto the recording material P at the secondary transfer position T2. The intermediary transfer belt 181 is adjusted to have a volume resistivity of $1\times10^{9}$-$1\times10^{14}$ Ω/cm by incorporating carbon black into each of the layers.

The image forming apparatus 100 is required to individually meet diversifying recording material species. In order to improve a transfer property onto such a recording material that has an uneven surface layer, the intermediary transfer belt 181 including the elastic layer 181*b* is employed. The intermediary transfer belt 181 is soft since it includes the elastic layer 181*b*, and can reduce a pressure acting on the toner image at the secondary transfer position T2. For this reason, such an intermediary transfer belt 181 has an effect on not only improvement in transfer property onto general-purpose paper but also transfer property onto thick paper and paper having unevenness.

The intermediary transfer belt 181 includes the soft elastic layer 181*b*, and therefore in a conventional blade cleaning device using the cleaning blade, a friction resistance becomes large. For this reason, in order to collect the toner from the intermediary transfer belt 181 in a downstream side of the secondary transfer position T2, a belt cleaning device 116 of an electrostatic fur brush type in which the toner is collected electrostatically by rubbing the intermediary transfer belt 181 with a fur brush is employed.

(Belt Cleaning Device)

Figure 3:
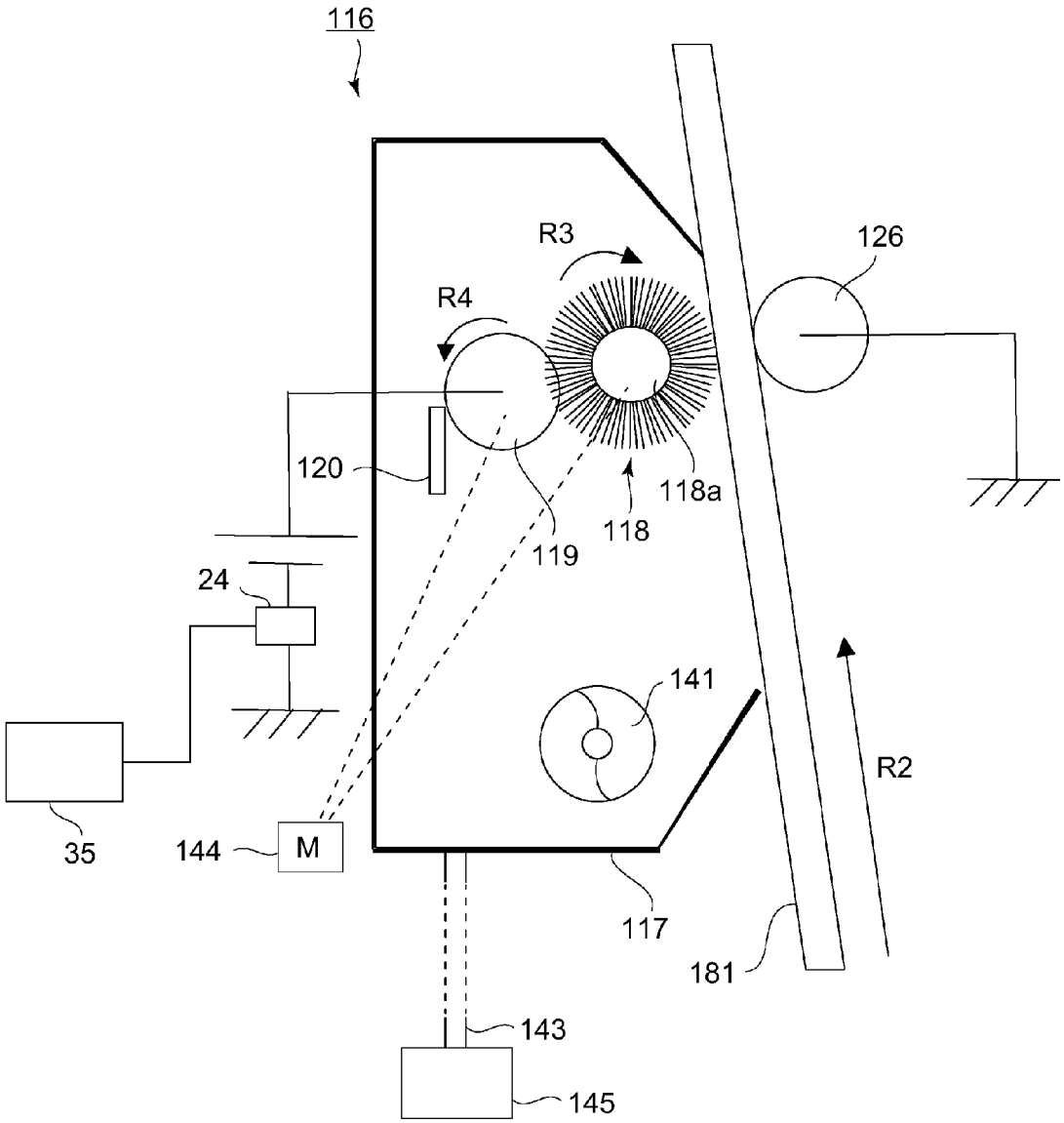
FIG. 3 is an illustration of a structure of a belt cleaning device.

FIG. 3 is an illustration of a structure of the belt cleaning device 116.

As shown in FIG. 3, the belt cleaning device 116 is an electrostatic belt cleaning device for collecting electrostatically the toner triboelectrically charged by rubbing the surface of the intermediary transfer belt 181 with fur brush 118 to which a DC voltage is applied. The belt cleaning device 116 includes, inside a housing 117 provided in the neighborhood of the intermediary transfer belt 181, the fur brush 118, a metal roller 119 and a cleaning blade 120.

The fur brush 118 is $0.3\times10^6$ Ω/cm in resistance of fibers of the brush and 6 deniers in thickness of the fibers. The fur brush 118 is prepared by plating carbon black-dispersed nylon fibers on a core metal roller 118*a* at a fiber-plating density of 500,000 fibers/inch$^2$.

The fur brush 118 is disposed with a penetration amount of about 1.0 mm in the intermediary transfer belt 181, and is driven by a driving motor 144, thus being rotated in an arrow R3 direction at a peripheral speed of 50 mm/sec.

The metal roller 119 is provided in contact with the fur brush 118, and is an aluminum roller having a mirror-finished surface. The metal roller 119 electrostatically collects the toner from the fur brush 118. The metal roller 119 is disposed with a penetration amount of about 1.0 mm in the fur brush 118, and is driven by the driving motor 144, thus being rotated in an arrow R4 direction at a peripheral speed equal to the peripheral speed of the fur brush 118.

A cleaning voltage output portion 24 applies a positive DC voltage to the metal roller 119. The cleaning voltage output position 24 detects values of currents flowing into the metal roller 119 in real time, and effects constant-current control for controlling an output voltage so that each of the detected current values coincides with a predetermined value determined by a controller 35. When the DC voltage is applied to the metal roller 119, a potential difference is generated between the fur brush 118 and the intermediary transfer belt 181, so that the negative toner in the transfer residual toner on the intermediary transfer belt 181 is adsorbed by the fur brush 118.

The cleaning blade 120 is an urethane blade disposed with a penetration amount of 1.0 mm in the metal roller 119. The cleaning blade 120 scrapes off the toner deposited on the metal roller 119 into the housing 117. A feeding screw 141 feeds the toner in the housing 117 to one of longitudinal end positions of the belt cleaning device 116. The toner collected at the one of longitudinal end positions of the belt cleaning device 116 is accumulated in a collecting container 145 via a discharging pipe 143.

Even when the negatively charged toner on the intermediary transfer belt 181 is removed by the belt cleaning device 116, the toner having no polarity and the positively charged toner remain on the intermediary transfer belt 181. However, the toner having no polarity and the positively charged toner are transferred back onto the photosensitive drum 101*a* at the primary transfer portion, and therefore less remain on the intermediary transfer belt 181. For that reason, the positively charged transfer residual toner is prevented from remaining on the intermediary transfer belt 181 and from being transferred onto the recording material P at the secondary transfer portion T2, so that the fixed image formed on the recording material P is not adversely affected by the positively charged transfer residual toner.

(White Void Phenomenon at Trailing End Portion of Recording Material)

Figure 4:
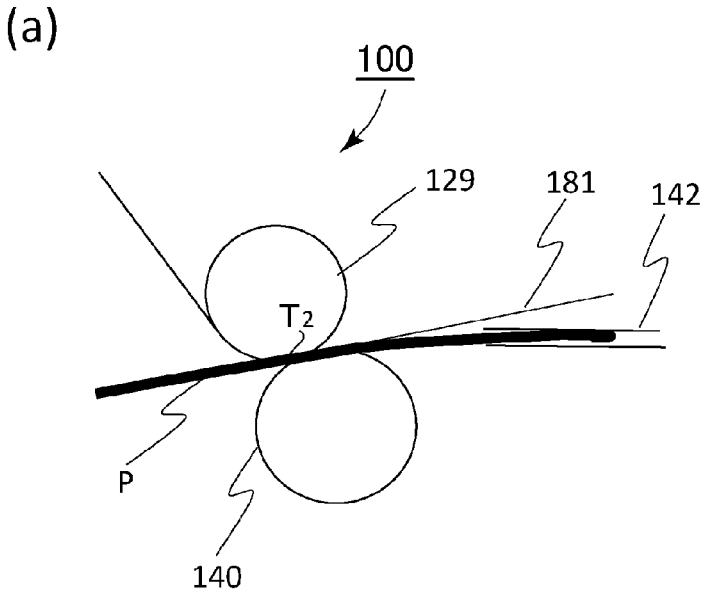
In FIG. 4, (a) and (b) are illustrations of a white void phenomenon at a trailing end portion of a recording material.
Figure 4:
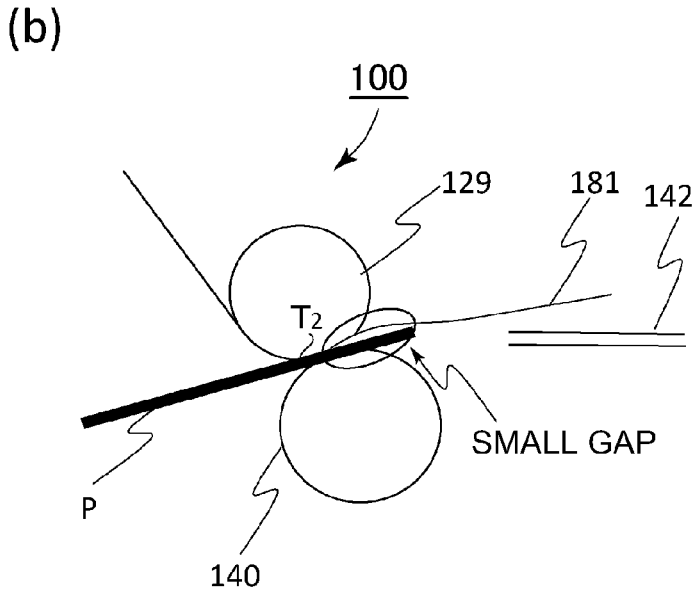

In FIG. 4, (a) and (b) are illustrations of a white void phenomenon at a trailing end portion of the recording material P, and schematically show a state in which so-called thick paper (recording material) having a basis weight (weight per unit area) of 209 (g/m$^2$) passes through the secondary transfer portion T2.

As shown in (a) of FIG. 4, in the image forming apparatus 100, a front transfer guide 142 is provided at a front position of the secondary transfer portion T2, and the recording material P is superposed no the intermediary transfer belt 181 at a position upstream of the secondary transfer portion T2. At this time, in a range from a leading end of the recording material P to a front position of a trailing end portion of the recording material P with respect to a feeding direction of the recording material P, a trailing end of the recording material P is regulated by the front transfer guide 142, and therefore an attitude of the recording material P and a contact state between the intermediary transfer belt 181 and the recording material P are stable. However, as shown in (b) of FIG. 4, after the trailing end of the recording material P comes out of the front transfer guide 142, the contact state between the trailing end portion of the recording material which is out of regulation and the intermediary transfer belt 181 becomes unstable, so that improper transfer which is called white void is liable to generate.

As shown in (a) of FIG. 4, when the leading end portion of the recording material P passes through the secondary transfer portion T2, the recording material P is guided by front transfer guide 142 and is introduced into the secondary transfer portion T2. At this time, a part of the recording material P with respect to the feeding direction is regulated in attitude by the front transfer guide 142, and therefore the recording material P is pushed down by the front transfer guide 142, so that the recording material P is guided into the secondary transfer portion T2 in such an attitude that the recording material P follows the intermediary transfer belt 181 from an upstream side of the secondary transfer portion T2. As a result, in an upstream region of the secondary transfer portion T2, the recording material P and the intermediary transfer belt 181 are stably in close contact with each other, so that a gap therebetween is not readily formed.

On the other hand, as shown in (b) of FIG. 4, when the trailing end portion of the recording material P with respect to the feeding direction passes through the secondary transfer portion T2, the recording material P has already come out of the front transfer guide, and therefore the attitude of the recording material is not regulated by the front transfer guide 142. The trailing end portion of the recording material P nipped at the secondary transfer portion T2 is high in rigidity, and therefore pushes up the intermediary transfer belt 181 from below, so that the contact state between the recording material P and the intermediary transfer belt 181 in the upstream region of the secondary transfer portion T2 is unstabilized.

When a small gap is generated between the recording material P and the intermediary transfer belt 181 in a region where a voltage is applied to the recording material P at the upstream position of the secondary transfer portion T2, electric discharge generated in the gap generates an image defect, due to an electric discharge trace, which is called a white void phenomenon in some cases. When the electric discharge generates in the gap, a toner charge polarity is reversed in a dot shape in a range where the electric discharge generates, so that the toner which will be transferred onto the recording material P during passing through the secondary transfer portion T2 remains on the intermediary transfer belt 181 in the dot shape. As a result, a portion of the recording material P on which the toner is not transferred in the dot shape forms a white void image and appears in the fixed image on the recording material P.

The white void phenomenon does not readily generate on the recording material P, having a low rigidity, such as plain paper or thin paper. For example, the white void phenomenon does not generate on the recording material of 80 (g/m$^2$) in basis weight but is liable to generate no the recording material of 209 (g/m$^2$) in basis weight. This difference is largely affected by the rigidity of paper (recording material). When the rigidity of the recording material P is low, the formation of the small gap between the recording material P and the intermediary transfer belt 181 by the pushing-up of the intermediary transfer belt 181 from below at the trailing end of the recording material P even after the recording material P comes out of the front transfer guide 142 is prevented.

However, even in the case where the rigidity of the material for the recording material P is low, an apparent rigidity is high when the recording material P is curled, and therefore there is a possibility that the trailing end of the recording material P partly pushes up the intermediary transfer belt 181 to form the small gap between the recording material P and the intermediary transfer belt 181. In this case, the white void phenomenon partly generates. Therefore, in an operation in a double-side image forming mode, the recording material P pressed and heated by the fixing device 165 in image formation on a first surface thereof is liable to generate curling, and therefore even in the case of the plain paper, the white void phenomenon is liable to generate in the image formation on a second surface of the recording material P.

When the white void phenomenon generates, the transfer residual toner positively charged by abnormal electric discharge at each of white void positions generates in a considerable amount, and is deposited on the intermediary transfer belt 181 and then is fed to the belt cleaning device 116, thus slipping through the fur brush 118 to which the positive voltage is applied. However, the positively charged transfer residual toner is transferred onto the photosensitive drum 101*a* at the primary transfer portion and is removed from the intermediary transfer belt 181, and therefore does not cause the image defect resulting from the transfer thereof onto the recording material P at the secondary transfer portion T2.

In the image forming apparatus, the white void phenomenon is suppressed by lowering an absolute value of the transfer voltage applied to the secondary transfer portion T2 with respect to the trailing end portion of the recording material P coming out of the front transfer guide 142.

(Secondary Transfer Voltage Control)

Figure 5:
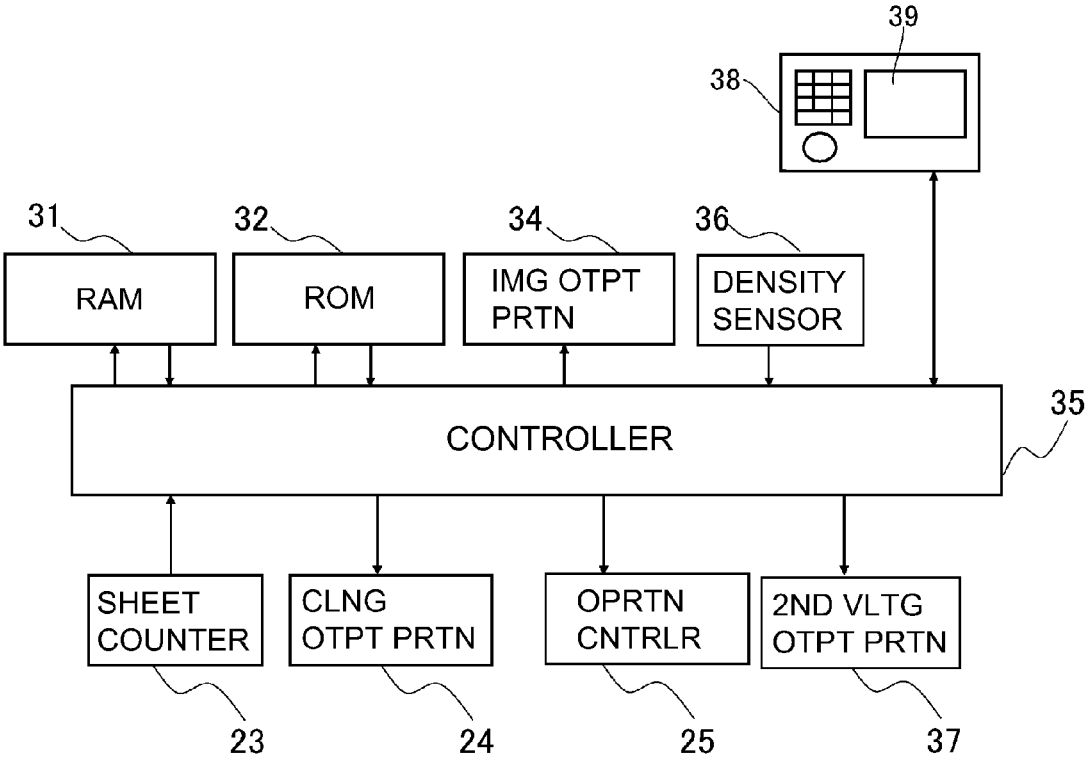
FIG. 5 is a block diagram of a control system of the image forming apparatus.
Figure 6:
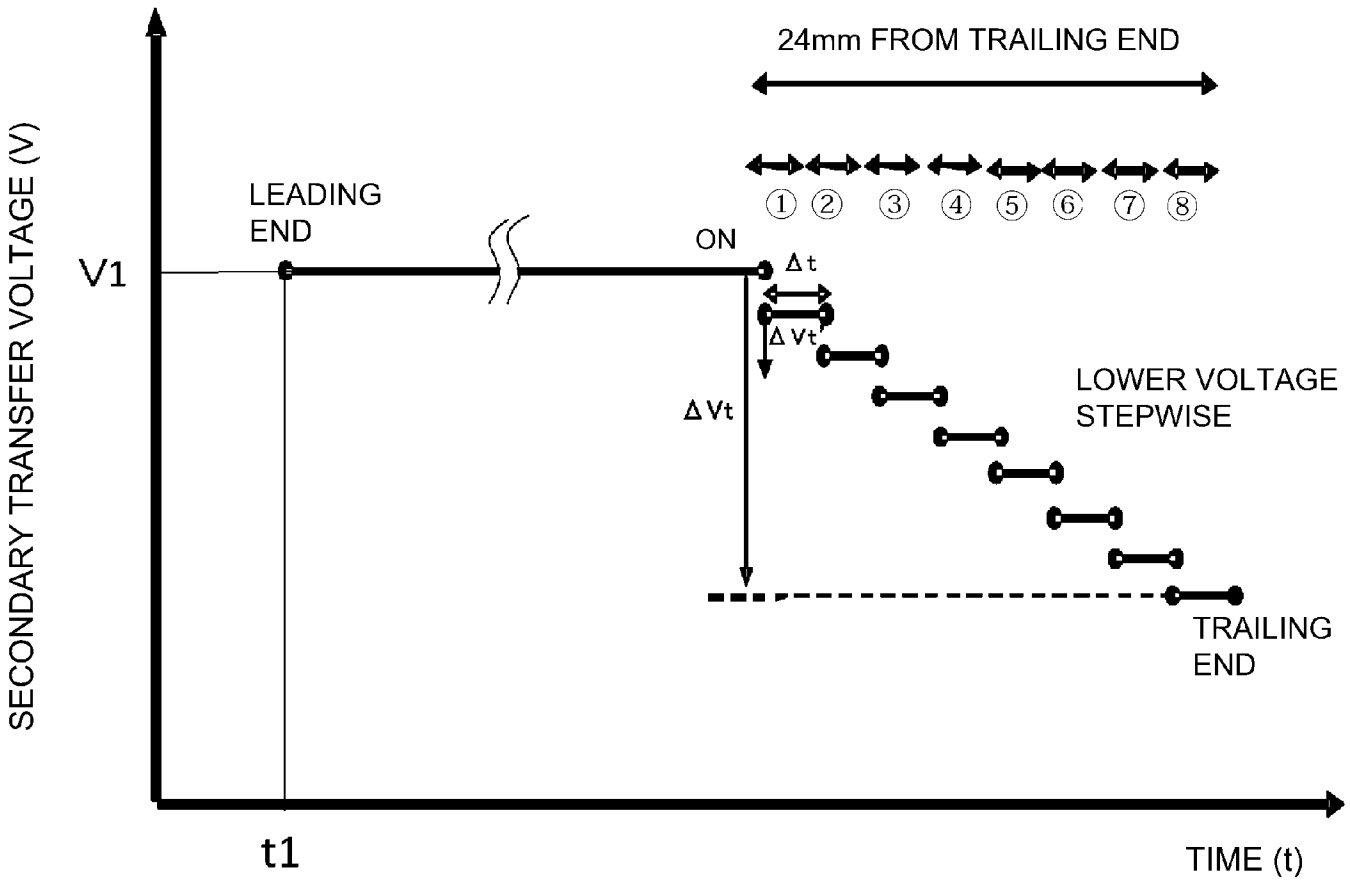
FIG. 6 is an illustration of secondary transfer voltage control for suppressing the white void phenomenon.

FIG. 5 is a block diagram of a contact system of the image forming apparatus. FIG. 6 is an illustration of secondary transfer voltage control for suppressing the white void phenomenon.

As shown in FIG. 5, the controller 35 controls a secondary transfer voltage output portion 37 to adjust the transfer voltage applied to the secondary transfer roller 140.

The belt cleaning device 116 uses only the fur brush 118 to which the positive voltage is applied, and therefore cannot remove the positively charged toner on the intermediary transfer belt 181. The positively charged transfer residual toner slips through the fur brush 118 to which the positive voltage is applied and is transferred back onto the photosensitive drum 101*a* at the primary transfer portion, thus being removed from the intermediary transfer belt 181.

However, an amount of the toner transferred back onto the photosensitive drum 101*a* and an electric charge amount have limitation, and therefore there is a need to optimize a secondary transfer voltage V1 applied to the secondary transfer portion T2 so that the amount of the transfer residual toner positively charged on the intermediary transfer belt 181 is not excessive. At the secondary transfer portion T2, a voltage condition in which the positively charged transfer residual toner does not readily generate on the intermediary transfer belt 181 is set. By setting the secondary transfer voltage V1 so that an absolute value of the secondary transfer voltage V1 is not higher than an absolute value of a voltage providing a maximum transfer efficiency, even when the negatively charged toner increases somewhat, the positively charged toner is decreased in amount.

As shown in FIG. 6, a time t1 shows the time when the leading end of the recording material P reaches the secondary transfer portion T2. The controller 35 applies the secondary transfer voltage V1 to the secondary transfer roller 140 from the time t1, so that the toner image is transferred from the intermediary transfer belt 181 onto the recording material P.

The secondary transfer voltage V1 is changed depending on an environmental (ambient) humidity of the image forming apparatus and a basis weight (weight per unit area) of the recording material P. With a lower humidity environment, resistance values of the intermediary transfer belt 181 and the secondary transfer roller 140 are higher, and therefore in order to ensure a necessary transfer current, the secondary transfer voltage V1 applied to the secondary transfer roller 140 is set at a high level. A resistance value of the recording material P is higher with a larger basis weight of the recording material P, and therefore the secondary transfer voltage V1 applied to the secondary transfer roller 140 is similarly set at the high level.

In a region of 24 mm from the trailing end of the recording material P, in order to suppress the white void phenomenon at the trailing end portion of the recording material P, the controller 35 stepwise lowers the transfer voltage applied to the secondary transfer roller 140 to (V1−ΔVt). This is because by lowering the voltage applied to the secondary transfer portion T2, the electric discharge does not readily generate even when the small gap is formed between the recording material P and the intermediary transfer belt 181 in the upstream region of the secondary transfer portion T2. In the region of 24 mm from the trailing end of the recording material P, the secondary transfer voltage V1 stepwise lowers to a voltage (V1−ΔVt).

TABLE 1

| Basis | Environmental humidity (%) | | | | |
|---|---|---|---|---|---|
| Weight (g/m$^2$) | ≤10 | 11-30 | 31-50 | 51-70 | ≥71 |
| ≤80 | 0 | 0 | 0 | 0 | 0 |
| 81-150 | 0 | 0 | 0 | 0 | 0 |
| 151-200 | 50 V | 0 | 0 | 0 | 0 |
| 201-250 | 100 V | 50 V | 0 | 0 | 0 |
| ≥251 | 150 V | 100 V | 50 V | 0 | 0 |

As shown in Table 1, a lowering range ΔVt of the secondary transfer voltage V1 varies depending on a combination of the basis weight of the recording material P with the environmental humidity. In the low humidity environment, in addition to the increase in resistance value of the intermediary transfer belt 181 and the secondary transfer roller 140, the electrical discharge is liable to generate compared with that in a high humidity environment, and therefore the lowering range ΔVt is set at a large value. The resistance value of the recording material P is higher with a larger basis weight of the recording material P, and therefore the secondary transfer voltage V1 is increased, and also the lowering range ΔVt is set at a large value correspondingly thereto. The lowering range ΔVt is stored, in RAM 31, as a table depending on the basis weight of the recording material P and the humidity determined from an operation environment of the image forming apparatus.

As shown in FIG. 6 with reference to FIG. 5, the controller 35 starts output of the voltage from the secondary transfer voltage output portion 37 to the secondary transfer roller 140 at the time t1 determined by adding a margin to the time when the recording material P reaches the secondary transfer portion T2.

The controller 35 detects the resistance of the secondary transfer portion T2 by effecting constant-current control of the secondary transfer voltage output portion 37, and arithmetically operates a constant voltage so as to obtain a predetermined transfer current. Before the recording material P is fed to the secondary transfer portion T2, a predetermined transfer current value I (μA) necessary to secondary-transfer the toner image is outputted from the secondary transfer voltage output portion 37, and a sharing voltage of the recording material P is added to an output voltage at that time, so that the secondary transfer voltage V1 is obtained. The sharing voltage of the recording material P is a constant voltage necessary to pass, through the recording material P, the predetermined transfer current value I (μA) necessary to secondary-transfer the toner image.

In order to suppress the white void phenomenon at the trailing end portion of the recording material, the controller 35 lowers stepwise the output voltage of the secondary transfer voltage output portion 37 from the position of 24 mm from the trailing end of the recording material P by the lowering range of ΔVt at 8 levels. By stepwise lowering the secondary transfer voltage with fine lower range, an abrupt lowering of the transfer efficiency in the trailing end portion of the recording material is prevented, so that an image density is continuously changed to make a lowering in density less conspicuous.

(Detective Cleaning)

As described above, the image forming portion Pa which is an example of the image forming portion forms the toner image. The intermediary transfer belt 181 which is an example of the intermediary transfer member carries and moves the toner image formed at the Pa. The secondary transfer roller 140 which is an example of the transfer member contacts the intermediary transfer belt 181 to form the secondary transfer portion T2 which is an example of the transfer portion. The secondary transfer voltage output portion 37 which is an example of the transfer voltage source applies the transfer voltage to the secondary transfer portion T2 so that the toner image is transferred from the intermediary transfer belt 181 onto the recording material passing through the secondary transfer portion T2. The fur brush 118 which is an example of the cleaning member contacts the intermediary transfer belt 181 to form the cleaning portion for removing the toner on the intermediary transfer belt 181 passed through the secondary transfer portion T2. The cleaning voltage output portion 24 which is an example of the cleaning voltage source applies the cleaning voltage to the cleaning portion so that the toner is transferred from the intermediary transfer belt 181 onto the fur brush 118.

Incidentally, the electrostatic brush cleaning device is inferior in cleaning performance to the blade cleaning device using the cleaning blade. The cleaning performance of the electrostatic brush cleaning device is largely influenced by the charge amount and the toner amount of the transfer residual toner since the toner is electrostatically attracted to the fur brush and then is delivered to the metal roller in principle. For example, in the low humidity environment in which the toner charge amount is large, in addition to the increase in amount of the transfer residual toner by the lowering in secondary transfer efficiency of the toner image at the secondary transfer portion T2, the amount per unit area of the toner attracted to the fibers of the fur brush becomes small, and therefore defective cleaning is liable to generate.

When the transfer voltage is lowered in the trailing end portion of the recording material P in order to suppressed the white void phenomenon, the secondary transfer efficiency of the toner image at the secondary transfer portion T2 is lowered and the transfer residual toner increases in amount, and therefore a degree of the cleaning of the intermediary transfer belt 181 is liable to be insufficient. In the region on the intermediary transfer belt 181 lowered in transfer voltage, the amount of the transfer residual toner increases compared with the region of the intermediary transfer belt 181 which is not lowered in transfer voltage, so that a load of the belt cleaning device increases and thus the defective cleaning is liable to generate.

As shown in FIG. 6, the transfer voltage is lowered with a position closer to the trailing end of the recording material P, and therefore the transfer residual toner increases on the intermediary transfer belt 181. When the absolute value of the transfer residual toner is lowered during the passing of the trailing end portion of the recording material P through the secondary transfer portion T2, in the region of the intermediary transfer belt 181 contacting the trailing end portion of the recording material P, the amount of the transfer residual toner remaining on the intermediary transfer belt 181 without being transferred onto the recording material P increases. As a result, by the belt cleaning device 116 as the electrostatic cleaning device, the region of the intermediary transfer belt 181 contacting the trailing end portion of the recording material P cannot be sufficiently cleaned.

That is, the belt cleaning device 116 effects the cleaning by electrostatically attracting the toner to the fur brush in principle, and therefore is largely influenced by the charge amount and the toner amount of the transfer residual toner. Particularly, in a condition in which the secondary transfer efficiency is lowered in the lower humidity environment where the toner charge amount is large, the toner cannot be attracted in an area not less than a surface area of the fibers of the fur brush, so that the defective cleaning is liable to generate. Particularly, in the white void correction control for lowering the transfer voltage in the trailing end portion of the recording material, the transfer voltage is lowered stepwise in the trailing end portion relative to a central region with respect to the recording material feeding direction, and therefore the transfer efficiency is liable to lower at the position closer to the trailing end. Correspondingly, the amount of the toner to be removed increases, so that the defective cleaning generates in some cases.

Therefore, in this embodiment, in the case where the secondary transfer voltage is lowered in the trailing end portion of the recording material P in order to suppress the white void phenomenon, in the region of the intermediary transfer belt 181 contacting the trailing end portion of the recording material, the absolute value of the cleaning voltage applied to the fur brush 118 is increased. In the trailing end portion of the recording material P in which the contact between the recording material P and the intermediary transfer belt 181 is liable to become unstable, the output voltage of the cleaning voltage output portion 24 is increased stepwise, so that the cleaning performance of the fur brush 118 is enhanced stepwise.

As a result, the absolute value of the transfer voltage is increased in the trailing end portion of the recording material P. Further, in the region of the intermediary transfer belt 181 where the amount of the transfer residual toner increases by contact with the trailing end portion of the recording material P, the absolute value of the contact voltage is increased, so that the transfer residual toner on the intermediary transfer belt 181 is electrostatically removed. In such a manner, the transfer residual toner on the intermediary transfer belt 181 is electrostatically removed sufficiently while suppressing sufficiently the white void phenomenon at the secondary transfer portion T2 by lowering the transfer voltage.

(Cleaning Voltage Control)

Figure 7:
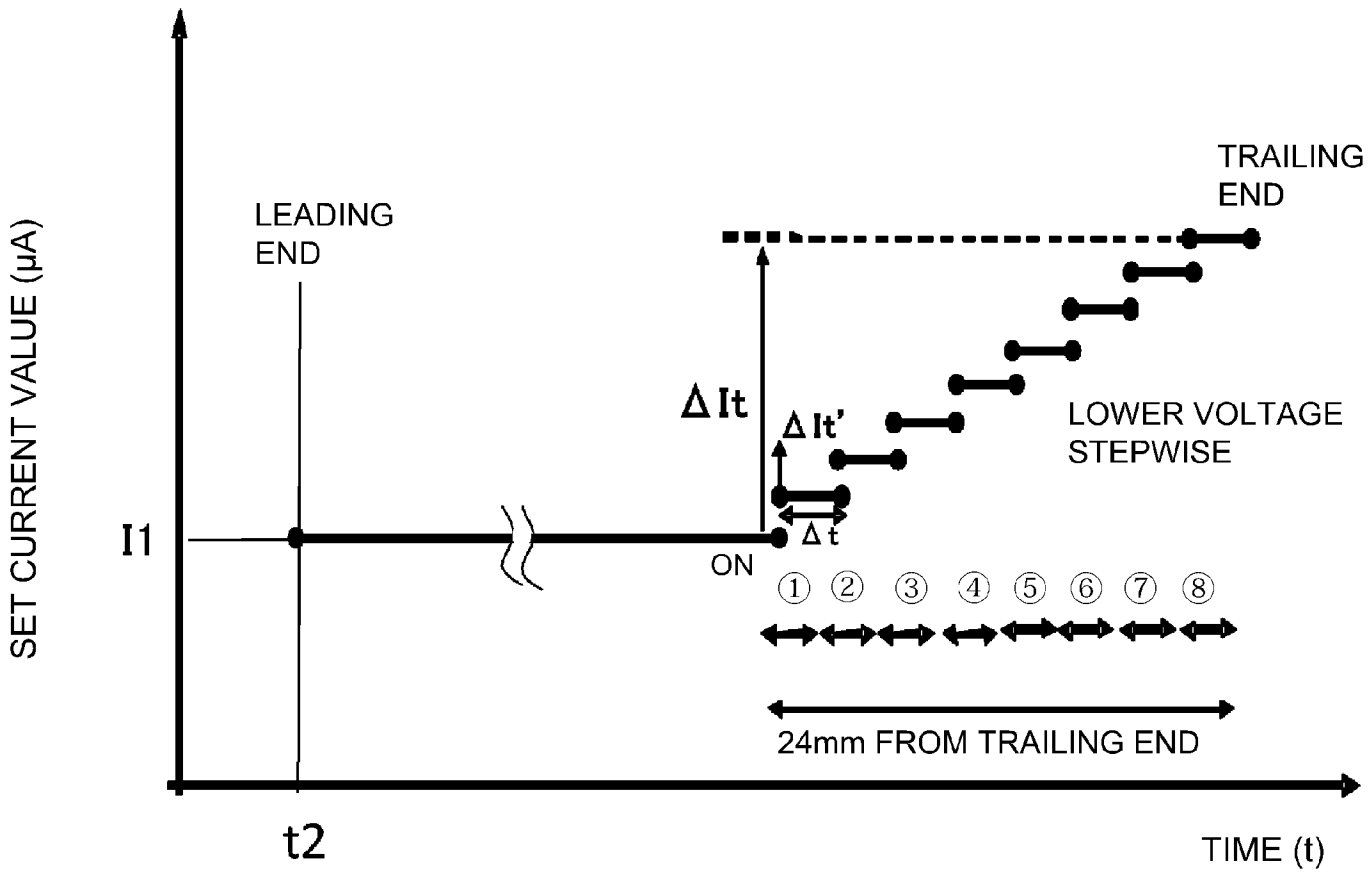
FIG. 7 is an illustration of a cleaning voltage control for enhancing a cleaning performance.

FIG. 7 is an illustration of cleaning voltage control for enhancing the cleaning performance. As shown in FIG. 5 with reference to FIG. 5, a time t2 shows the time when the region of the intermediary transfer belt 181 contacting the leading end of the recording material P reaches the belt cleaning device 116. The controller 35 effects constant-current control of the cleaning voltage output portion 24 at a set current value I1 from the time t2. When the voltage applied to the fur brush 118 is excessively low, the negatively charged transfer residual toner on the intermediary transfer belt 181 cannot be sufficiently collected. On the other hand, when the voltage applied to the fur brush 118 is excessively high, the electric discharge generates on the fur brush 118, so that the positively charged transfer residual toner generates on the intermediary transfer belt 181. For that reason, the set current value I1 in the constant-current control of the cleaning voltage output portion 24 is finely changed in positional synchronism with the lowering in transfer voltage.

TABLE 2

| | Environmental humidity (%) | | | | |
|---|---|---|---|---|---|
| | ≤10 | 11-30 | 31-50 | 51-70 | ≥71 |
| SCV*1 (μA) | +40 | +35 | +30 | +25 | +20 |

*1"SCV" is the set current value.

As shown in Table 2, the set current value I1 in the constant-current control at the cleaning voltage output portion 24 during the image formation is changed depending on the environmental humidity of the image forming apparatus 100. The controller 35 arithmetically operates, depending on the environmental humidity, a proper set current value I1 for removing the transfer residual toner on the intermediary transfer belt 181 passes through the secondary transfer portion T2.

In the low humidity environment, compared with a high humidity environment, in addition to the increase in toner charge amount of the transfer residual toner on the intermediary transfer belt 181, the transfer efficiency lowers and also the amount of the transfer residual toner increases. For this reason, in the low humidity environment, the controller 35 sets the set current value I1 in the constant-current control at a value higher than that in the high humidity environment. The toner charge amount and the toner amount of the transfer residual toner on the intermediary transfer belt 181 is also changed depending on a transfer condition (voltage, pressure, speed) at the secondary transfer portion T2, but an optimum transfer condition for the secondary transfer portion T2 is set in view of an image property, and therefore the transfer condition does not influence the amounts described above compared with the environmental humidity. From the position of the intermediary transfer belt 181 contacting the position of 24 mm from the trailing end of the recording material P, the controller 35 stepwise increases the set current value I1 in the constant-current control at the cleaning voltage output portion 24 at 8 levels. The set current value I1 is increased stepwise in the region of the intermediary transfer belt 181 where the secondary transfer voltage V1 is lowered stepwise at the secondary transfer portion T2, so that the cleaning condition is optimized and thus the transfer residual toner is satisfactorily removed.

An increasing range ΔI of the set current value is determined by the controller from the environmental humidity of the image forming apparatus and information stored in the RAM 31. The increasing range ΔI of the set current value at the trailing end portion of the recording material P is shown in Table 3.

TABLE 3

| Basis | Environmental humidity (%) | | | | |
|---|---|---|---|---|---|
| Weight (g/m$^2$) | ≤10 | 11-30 | 31-50 | 51-70 | ≥71 |
| ≤80 | 0 | 0 | 0 | 0 | 0 |
| 81-150 | 0 | 0 | 0 | 0 | 0 |
| 151-200 | +5 μA | 0 | 0 | 0 | 0 |
| 201-250 | +7 μA | +5 μA | 0 | 0 | 0 |
| ≥251 | +10 μA | +7 μA | +5 μA | 0 | 0 |

As shown in Table 3, the increasing range ΔI of set current value I1 varies depending on the environmental humidity and the basis weight (g/m$^2$) of the recording material P. In Table 3, correction amounts for the set current value I1 of the cleaning voltage output portion 24 are determined corresponding to the correction amounts for the secondary transfer voltage at the secondary transfer portion T2 shown in Table 1.

(Effect of Cleaning Voltage Control)

With respect to four combinations of the presence and absence of stepwise lowering in secondary transfer voltage at the trailing end portion of the recording material with the presence and absence of stepwise increase in set current value I1 of the cleaning voltage output portion 24, evaluation of the presence or absence of generation of the white void phenomenon and the presence or absence of the defective cleaning was made.

TABLE 4

| | | | STP*1 | |
|---|---|---|---|---|
| | | | NO TERC*2 | With TERC*2 |
| Belt cleaning device | No TERC*2 | TERI*3 | YES | NO |
| | | DC*4 | NO | YES |
| | With TERC*2 | TERI*3 | YES | NO |
| | | DC*4 | NO | NO |

*1"STP" is the secondary transfer portion.

*2"TERC" is the trailing end portion correction.

*3"TERI" is the trailing end portion image. "YES" means that the white void phenomenon generated, and "NO" means that the white void phenomenon did not generate.

*4"DC" is the defective cleaning. "YES" means that the defective cleaning generated, and "NO" means that the defective cleaning did not generate.

As shown in Table 4, at the secondary transfer portion T2, the secondary transfer voltage V1 is stepwise lowered, so that the white void phenomenon in the trailing end portion of the recording material P is avoided. On the other hand, when the secondary transfer voltage V1 is stepwise lowered at the secondary transfer portion T2, image contamination due to the defective cleaning generates on the output image in the trailing end portion of the recording material P. The secondary transfer voltage is excessively small in the trailing end portion of the recording material P to lower the transfer efficiency, and the generation amount of the transfer residual toner increases, so that the amount of the transfer residual toner which cannot be completely removed by the belt cleaning device increases.

However, when the set current value I1 is stepwise increased in the region of the intermediary transfer belt 181 contacting the trailing end portion of the recording material P, the cleaning performance of the fur brush 118 is enhanced, so that the defective cleaning is eliminated and thus the generation of the image defect is suppressed.

(Collection of Transfer Residual Toner by Image Forming Portion)

As shown in FIG. 1, in Embodiment 1, the belt cleaning device 116 uses only the fur brush 118 to which the positive voltage is applied, and therefore the positively charged toner on the intermediary transfer belt 181 cannot be removed. The positively charged toner generating at a predetermined proportion at the secondary transfer portion T2 with the image formation slips through the fur brush 118 to which the positive voltage is applied and reaches the image forming portions Pa, Pb, Pc and Pd.

However, during the image formation, the positive transfer voltage is continuously applied to the primary transfer rollers 124*a*, 124*b*, 124*c* and 124*d*, and therefore the positively charged toners on the intermediary transfer belt 181 are transferred back onto the photosensitive drums 101*a*, 101*b*, 101*c* and 101*d*. The toners transferred back onto the photosensitive drums 101*a*, 101*b*, 101*c* and 101*d* are collected by the drum cleaning devices 112*a*, 112*b*, 112*c* and 112*d*, so that the toners have no influence on the image quality by being mixed into the output image.

(Effect of Embodiment 1)

As described above, in Embodiment 1, the first transfer voltage is applied when the first region of the intermediary transfer belt 181 passes through the secondary transfer portion T2, and the second transfer voltage higher in absolute value than the first transfer voltage is applied when the second region of the intermediary transfer belt 181 passes through the secondary transfer portion T2. For this reason, in the region where the intermediary transfer belt 181 contacts the region end of the recording material corresponding to the first region, the amount of the transfer residual toner is increased compared with the region where the intermediary transfer belt 181 contacts an intermediary position of the recording material corresponding to the second region.

Therefore, the controller 35 which is an example of the controller controls the cleaning voltage output portion 24 so that the cleaning voltage higher in absolute value in the first region of the intermediary transfer belt 181 than in the second region of the intermediary transfer belt 181 is applied at the cleaning portion. As a result, also in the first region of the intermediary transfer belt 181, the transfer residual toner is decreased, so that the image contamination can be alleviated.

Further, in Embodiment 1, when the position of the intermediary transfer member passed through the secondary transfer portion T2 when the absolute value of the transfer voltage changes in a small degree passes through the cleaning portion, the absolute value of the cleaning voltage is changed in a large degree. As a result, the cleaning voltage can be increased at the position where the amount of the transfer residual toner on the intermediary transfer belt 181 increases.

Further, in Embodiment 1, in the region of the intermediary transfer belt 181 where the transfer voltage gradually decreasing in absolute value was applied at the secondary transfer portion T2, the cleaning voltage gradually increasing in absolute value is applied at the cleaning portion. As a result, the cleaning performance can be enhanced in the region where the transfer residual toner on the intermediary transfer belt 181 is increased.

Further, in Embodiment 1, the primary transfer roller 124*a* which is an example of an electric field forming means is supplied with the primary transfer voltage to cause the electric field to act on the contact portion between the photosensitive drum 101*a* and the intermediary transfer belt 181. The controller 35 controls the primary transfer voltage so that the toner charged to the opposite polarity to the toner charge polarity is transferred on the photosensitive drum 101*a* when the region of the intermediary transfer belt 181 where the secondary transfer voltage gradually decreasing in absolute value passes through the contact portion. As a result, even when the toner charged to the opposite polarity to the toner charge polarity generates at the belt cleaning device 116, the toner can be removed from the intermediary transfer belt 181.

Further, in Embodiment 1, the front transfer guide 142 which is an example of the guiding member guides the recording material fed to the secondary transfer portion T2 so that the recording material is superposed on the surface of the intermediary transfer belt 181 moving toward the secondary transfer portion T2. The controller 35 stepwise lowers the absolute value of the transfer voltage, to be applied at the secondary transfer portion T2, in the trailing end portion of the recording material in a length corresponding to a distance from the trailing end position of the front transfer guide 142 to the secondary transfer portion T2 with respect to the recording material feeding direction. As a result, a large change in transfer efficiency is avoided, so that an abrupt change in fixed image density is avoided.

Further, in Embodiment 1, after the secondary transfer voltage is changed, the cleaning voltage is changed with a delay of the time obtained by dividing the distance between the secondary transfer portion T2 and the cleaning portion along the intermediary transfer belt 181 by the moving speed of the intermediary transfer belt 181. For this reason, a control load is alleviated compared with the case where an encoder pattern is formed on the intermediary transfer belt 181 to control a voltage application position.

<Embodiment 2>

Figure 8:
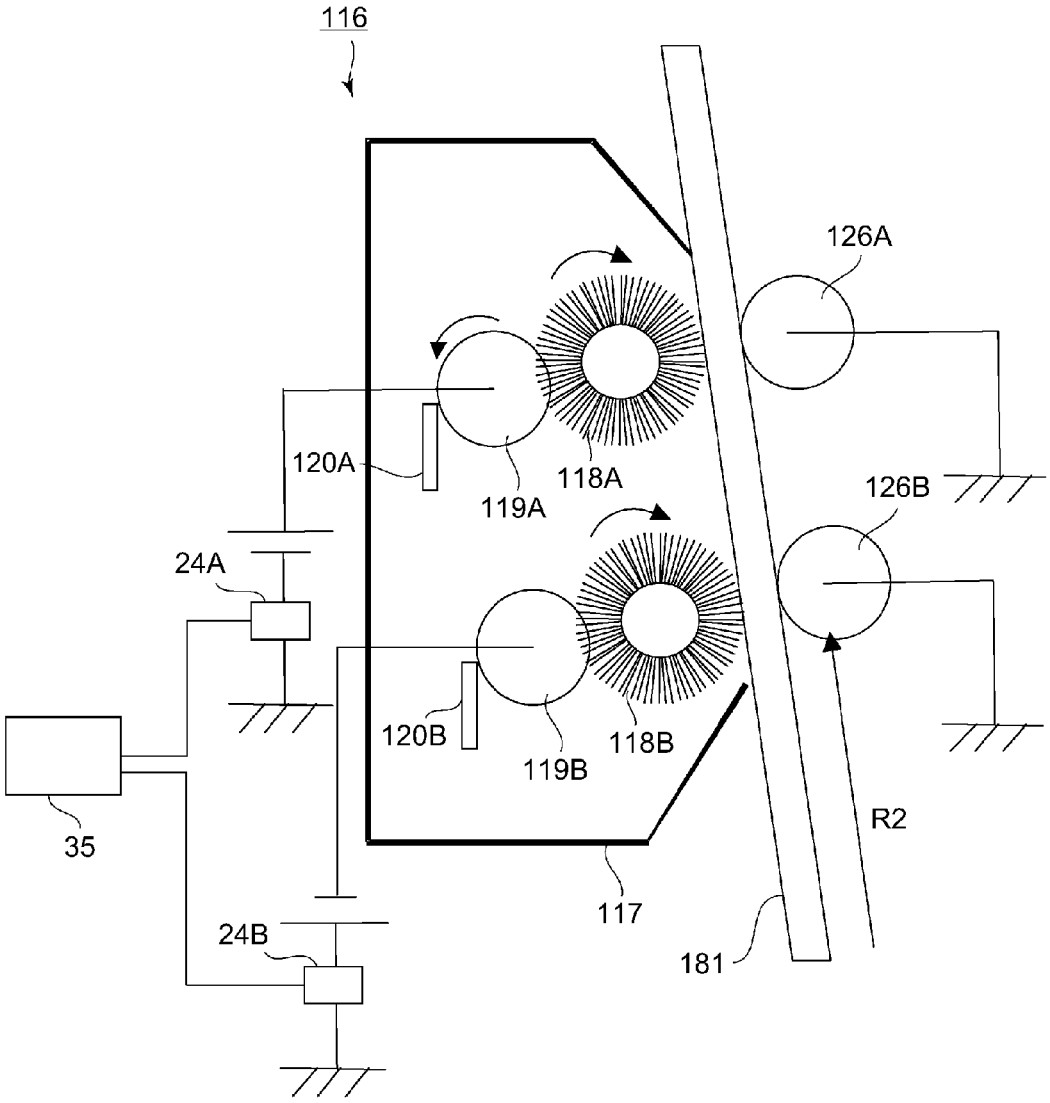
FIG. 8 is an illustration of a structure of a belt cleaning device in Embodiment 2.

FIG. 8 is an illustration of a structure of the belt cleaning device in this embodiment. In Embodiment 1, only the fur brush 118 to which the negative voltage is applied is disposed in the belt cleaning device 116. On the other hand, in this embodiment, as shown in FIG. 8, a fur brush 118A to which the negative voltage is applied and a fur brush 118B to which the positive voltage is applied are provided in the belt cleaning device 116. Other constituent elements in this embodiment are similar to those in Embodiment 1, and therefore the constituent elements common to FIG. 3 of Embodiment 1 and FIG. 8 of Embodiment 2 are represented by the same reference numerals or symbols in FIG. 3 and will be omitted from redundant description.

As described above, the transfer residual toner contains the toner having the cleaning voltage output portion 24 outputs the positive cleaning voltage to a metal roller 119A, so that the positive voltage is applied to the fur brush 118A. The toner negatively charged on the intermediary transfer belt 181 is electrostatically deposited on the fur brush 118A and then is transferred onto the metal roller 119A. Thereafter, the toner is scraped off and collected by a cleaning blade 120A.

The cleaning voltage output portion 24 outputs the negative cleaning voltage to a metal roller 119B, so that the negative voltage is applied to the fur brush 118B. The toner positively charged on the intermediary transfer belt 181 is electrostatically deposited on the fur brush 118B and then is transferred onto the metal roller 119B. Thereafter, the toner is scraped off and collected by a cleaning blade 120B.

(Change in Electric Charge)

The fur brush 118A to which the negative voltage is applied changes the polarity of the toner on the intermediary transfer belt 181 toward the negative side in some cases. For this reason, the positively charged toner on the intermediary transfer belt 181 is transferred onto the fur brush 118B, while the toner having a small charge amount is increased in charge amount toward the negative side, so that a collecting rate of the downstream fur brush 118A to which the positive voltage is applied can be increased.

However, it is not preferable that the toner negatively charged by the fur brush 118B to which the negative voltage is applied changes in polarity toward the negative side in the region of the intermediary transfer belt 181 on which the negatively charged toner is deposited by the contact with the trailing end portion of the recording material. This is because the toner strongly charged negatively is increased, in attraction force to the intermediary transfer belt 181 to lower a toner collecting rate of the fur brush 118A to which the positive voltage is applied.

Therefore, Embodiment 2, the negative voltage application to the fur brush 118B is turned off in the region of the intermediary transfer belt 181 increased in deposition amount of the negatively charged toner in contact with the trailing end portion of the recording material. As a result, the change in polarity of the toner on the intermediary transfer belt 181 toward the negative side is avoided, so that the transfer residual toner increased in amount by lowering the transfer voltage in the trailing end portion of the recording material is efficiently collected by the fur brush 118A.

When the negative voltage application to the fur brush 118B is turned off, the positively charged toner on the intermediary transfer belt 181 slips through the fur brushes 118A and 118B. However, as described above, the positively charged toner on the intermediary transfer belt 181 is collected by the photosensitive drums 101*a*, 101*b*, 101*c* and 101*d*, and therefore does not cause a large problem.

(Effect of Embodiment 2)

As described above, in Embodiment 2, the fur brush 118B which is an example of the upstream cleaning member contacts the intermediary transfer belt 181 at a position upstream of the fur brush 118A which is an example of the cleaning member with respect to the movement direction of the intermediary transfer belt 181. A cleaning voltage output portion 24B which is an example of an upstream cleaning voltage source applies another cleaning voltage so that the toner charged to the opposite polarity to the toner charge polarity is transferred onto the fur brush 118B.

During the passing, through the fur brush 118A, of the region of the intermediary transfer belt 181 to which the transfer voltage gradually decreasing in absolute value is applied, the controller 35 applies another cleaning voltage lower in absolute value than that before the region passes through the fur brush 118A. For this reason, the transfer residual toner on the intermediary transfer belt 181 changes in polarity toward the negative side, so that a degree of prevention of the cleaning with the fur brush 118B is small.

<Embodiment 3>

In Embodiment 1, as shown in FIG. 6, the length of the recording material trailing end portion where the transfer voltage is lowered was fixed at 24 mm. Further, the lowering range ΔVt in which the transfer voltage is lowered was fixed at the voltage depending on the environmental humidity and the recording material basis weight shown in Table 1. On the other hand, in Embodiment 3, in order to meet individually the diversified species of the recording material, the user is capable of setting individually the transfer voltage correction amount in the recording material trailing end portion depending on the species of the recording material used. In some cases, depending on the species of the recording material used by the user and the environmental condition of the image forming apparatus, the white void phenomenon generates at the fixed values as described above. In the control in Tables 1, 2 and 3 in Embodiment 1, in the case where the recording material for which the white void generation at the recording material trailing end portion cannot be sufficiently suppressed, the user operates the operating panel 38 to adjust the white void correction amount, so that the generation of the white void phenomenon can be decreased.

As shown in FIG. 1, when the user operates the operating panel 38 provided with a touch panel, in the image forming apparatus 100, the transfer voltage correction amount depending on the species of the recording material is automatically set at the secondary transfer output portion 37. The user operates the operating panel 38 and thus is capable of effecting adjustments of a glossiness property of the output image, specific margins, the transfer voltage, the cleaning voltage and the like. A screen for necessary adjusting items is activated at the display portion 39 of the operating panel 38, and then the user pushes a virtual button displayed on the touch panel of the display portion 39, thus being capable of executing necessary adjustment. As one of the adjusting items, a screen for the white void correction in the recording material trailing end portion is provided.

(Operating Panel)

Figure 9:
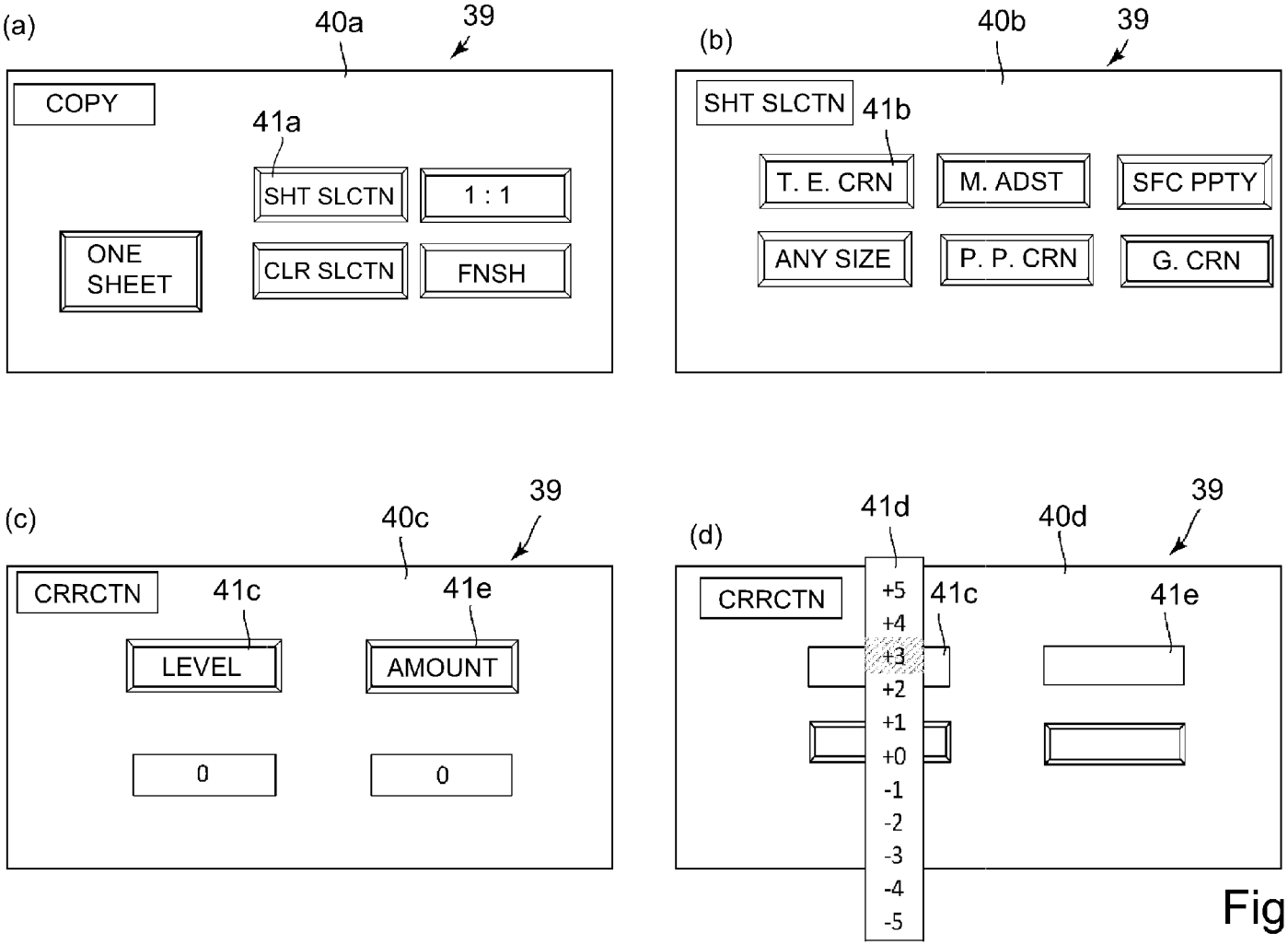
In FIG. 9, (a) to (d) are illustrations of operations through a display portion of an operating panel.

In FIG. 9, (a) to (d) are illustrations each showing an operation through the display portion of the operating panel. At the display portion 39 of the operating portion 38 shown in FIG. 5, screens 40*a*, 40*b*, 40*c* and 40*d* constituting a four-level hierarchy shown in FIG. 9 are displayable. By operating the touch panel of the display portions 39, it is possible to perform the adjustments of the glossiness property, the specific margin, the transfer voltage and the like. The adjustment can be performed by pushing a button displayed on the display portion 39 associated with each of the adjusting items. As one of the adjusting items, the trailing end portion white void correction is provided.

As shown in (a) of FIG. 9, on the screen 40*a*, buttons for arbitrarily enabling selection of sheet, the number of copying sheets, an image forming mode (color mode or monochromatic mode), a copying magnification and finishing are displayed. The user pushes a sheet selection button 41 displayed on the screen 40*a* in order to make individual setting with respect to the species of the recording material, so that a screen for the next hierarchy is activated.

As shown in (b) of FIG. 9, on the screen 40*b*, selection buttons each capable of enabling registration of necessary individual information by selecting either one of items such as trailing end portion white void correction, margin adjustment, paper surface property, any paper size, paper position adjustment and glossiness adjustment are displayed. The voltage pushes a trailing end portion white void correction button 41*b* in order to individually adjust the transfer voltage at the recording material trailing end portion, so that a screen for the next hierarchy is activated.

As shown in (c) of FIG. 9, on the screen 40*c*, selection buttons each capable of enabling registration of necessary individual information by selecting either one of items such as a correction level and a correction amount of the transfer voltage are displayed. The voltage pushes a correction level button 41*c* in order to individually adjust the correction level of the transfer voltage at the recording material trailing end portion, so that a screen for the next hierarchy is activated.

As shown in (d) of FIG. 9, on the screen 40*d*, a selection window 41*d* for selecting the correction level of the lowering range ΔVt shown in FIG. 6 is displayed in a manner that the selection window 41*d* overlaps with the screen 40*c*. As a default display value of the selection window, a numerical value of "0" is displayed, and the user can arbitrarily select the correction level of the transfer voltage in a range from −5 to +5. The default value of the lowering range ΔVt corresponding to the correction amount of "0" is a voltage value depending on the environmental humidity and the recording material basis weight shown in Table 1 of Embodiment 1.

(Automatic Adjustment of Cleaning Voltage)

Table 5 shows a relationship between the numerical value of the correction level and the lowering range ΔVt when the environmental humidity of the image forming apparatus is 8% and the basis weight of the recording material is 270 g. The lowering range ΔVt corresponding to the numerical value of "0" is 150 V similarly as in Table 1 of Embodiment 1.

TABLE 5

| | Correction level | | | | | | | | | | |
|---|---|---|---|---|---|---|---|---|---|---|---|
| | −5 | −4 | −3 | −2 | −1 | 0 | +1 | +2 | +3 | +4 | +5 |
| STP*1 ΔVt(V) | 25 | 50 | 75 | 100 | 125 | 150 | 175 | 200 | 225 | 250 | 275 |
| BCD*2 Δ(μA) | +2 | +2 | +4 | +6 | +8 | +10 | +12 | +14 | +16 | +18 | +20 |

*1"STP" is the secondary transfer portion.
*2"BCD" is the belt cleaning device.

As shown in Table 5, when the user changes the lowering range ΔVt from 150 V which is the default value, also the current value (the cleaning voltage applied to the fur brush 118) in the constant current control at the cleaning voltage output portion 24 is changed from 10 μA which is the default value. When the transfer voltage is changed, the amount and a charging state of the transfer residual toner on the intermediary transfer belt 181 are also changed, and therefore an optimum cleaning voltage changes. Particularly, when the transfer voltage correction level is adjusted toward the positive side, the amount of the transfer residual toner increases in the recording material trailing end portion, and therefore there is a need to increase the current value in the constant current control. For that reason, in the case where the user changes the transfer voltage correction level, the current value in the constant current control at the cleaning voltage output portion 24 is automatically offset in a range of 2-20 μA.

Then, as shown in (d) of FIG. 9, the user pushes a correction amount button 41*e* on the screen 40*d*, so that a selection window (unshown) for selecting a correction level of a length of the trailing end portion in which the transfer voltage on the recording material is lowered is displayed.

As a default display value of the selection window, a numerical value of "0" is displayed, and the user can arbitrarily select the correction level of the transfer voltage lowering region length in a range from −5 to +5.

(Automatic Adjustment of Cleaning Voltage Increasing Range)

Table 6 shows a relationship between the numerical value of the correction level and the length of the recording material trailing end portion where the transfer voltage is lowered when the environmental humidity of the image forming apparatus is 8% and the basis weight of the recording material is 270 g. The trailing end portion length corresponding to the numerical value of "0" is 24 mm as shown in Table 6.

TABLE 6

| | Correction amount | | | | | | | | | | |
|---|---|---|---|---|---|---|---|---|---|---|---|
| | −5 | −4 | −3 | −2 | −1 | 0 | +1 | +2 | +3 | +4 | +5 |
| STP*1 L*3(mm) | 0 | 5 | 10 | 15 | 20 | 24 | 30 | 35 | 40 | 45 | 50 |
| BCD*2 L*3(mm) | 0 | 5 | 10 | 15 | 20 | 24 | 30 | 35 | 40 | 45 | 50 |

*1"STP" is the secondary transfer portion.
*2"BCD" is the belt cleaning device.
*3"L" is the length from the trailing end.

As shown in Table 6, when the user changes the trailing end portion length from 24 mm which is the default value, also the increasing range of the cleaning voltage applied to the fur brush 118 is changed from 24 mm which is the default value. This is because depending on the increase and decrease in transfer voltage lowering range, there is a need to increase and decrease also the increasing range of the cleaning voltage applied to the fur brush 118. In the case where the user changes the length of the trailing end portion where the transfer voltage is lowered, the length of the trailing end portion where the cleaning voltage applied to the fur brush 118 is automatically offset in a range of 0-50 mm.

The user can individually adjust the transfer voltage lowering range ΔVt and the length of the trailing end portion where the transfer voltage is lowered in the ranges shown in Tables 5 and 6, respectively. In the case where the user uses the recording material having the high rigidity or the recording material having a large curling amount (in the case of the back surface printing in the double-side printing or the like), the user adjusts the correction level of each of the lowering range ΔVt and the trailing end portion length toward the positive side. The user discriminates the numerical value toward the positive side while observing the output image.

On the other hand, in the case where the user uses the recording material having the large basis weight but having the low rigidity or in the case where improper transfer generates at the recording material trailing end portion at the default setting, the user adjusts the correction level of each of the lowering range ΔVt and the trailing end portion length toward the negative. The user discriminates the numerical value toward the negative side while observing the output image.

When the user manually adjusts the lowering range ΔVt and the length of the transfer voltage lowering trailing end portion as described above, the controller 35 shown in FIG. 5 automatically adjusts the increasing range and the increasing length of the cleaning voltage correspondingly to the contents of other manual adjustment. By automatically adjust the increasing range and the increasing length of the cleaning voltage corresponding to the individual user setting, it is possible to satisfactorily remove the transfer residual toner in the region of the intermediary transfer belt 181 where the transfer voltage is lowered stepwise.

(Effect of Embodiment 3)

As described above, in Embodiment 3, the length of the region on the intermediary transfer belt 181 with respect to the movement direction is applicable at the secondary transfer portion T2 where the absolute value gradually decrease, through the operating panel 38 which is an example of a region adjusting portion. The controller 35 automatically adjusts, depending on the length of the region where the transfer voltage is changed, the movement direction length of the region of the intermediary transfer belt 181 at the cleaning portion where the cleaning voltage gradually increases in absolute value is applied. For this reason, it is possible to set the region, where the cleaning performance is enhanced, correspondingly to the region where the amount of the transfer residual toner increases.

In Embodiment 3, through the operating panel 38 which is an example of a change amount adjusting portion, a total change amount of the transfer voltage gradually decreasing in absolute value is adjustable. The controller 35 automatically adjusts, depending on the total change amount of the transfer voltage, a total change amount of the cleaning transfer voltage gradually increasing in absolute value. For this reason, it is possible to set a cleaning performance enhancing amount corresponding to the amount of the increase in transfer voltage.

As a result, in Embodiment 3, even in the case where the recording material having the high rigidity or in the case where the user individually adjusts the white void correction amount, it is possible to not only suppress the generation of the white void phenomenon in the recording material trailing end portion but also prevent the image contamination due to insufficient cleaning performance.

<Modified Embodiments>

The present invention can also be carried out in other embodiments in which a part or all of constituent elements in Embodiments 1, 2 and 3 are replaced with alternative constituent elements thereof. In Embodiment 1, only principal position relating to the toner image formation/transfer was described, but the present invention can be carried out in various uses such as printers, various printing machines, copying machines, facsimile machines and multi-function machines by adding necessary device, equipment and casing structure.

In Embodiment 1, the embodiment in which the fur brush was used as the cleaning member was described. However, the cleaning member may also be a metal roller. The number of the image forming portions may also be any number of one or more. The increment for changing the transfer voltage and the increment for changing the cleaning voltage may also be different from each other. At least one of the transfer voltage and the cleaning voltage may also be continuously changed.

A delay time of the change timing of the transfer voltage and the change timing of the cleaning voltage may also be controlled by a timer. The delay time may also be controlled by forming scales on the intermediary transfer belt and then by counting the scales through a magnetic sensor, an optical sensor or the like.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-104900 filed on May 21, 2014, which is hereby incorporated by reference herein in its entirety.

What is claimed is:

1. An image forming apparatus comprising:

a movable intermediary transfer member;

an image forming unit configured to form a toner image on said intermediary transfer member;

a transfer member, to which a first transfer voltage and a second transfer voltage can be applied, configured to transfer the toner image from said intermediary transfer member onto a recording material passing through a transfer portion formed between said transfer member and said intermediary transfer member;

a cleaning member, to which a first cleaning voltage and a second cleaning voltage can be applied, configured to remove toner on said intermediary transfer member passing through a cleaning portion formed between said cleaning member and said intermediary transfer member;

an executing portion capable of executing an operation in a lowering mode, in which the transfer voltage applied to the transfer member is changed from the first transfer voltage to the second transfer voltage lower in absolute value than the first transfer voltage, at a timing when a position of the recording material spaced from an upstream end portion of the recording material by a predetermined distance toward a downstream side with respect to a recording material feeding direction passes through the transfer portion; and a setting portion configured to set a first cleaning voltage and a second cleaning voltage such that an absolute value of the second cleaning voltage is higher than an absolute value of the first cleaning voltage, wherein in a case that the recording material passes through the transfer portion in the lowering mode, the first cleaning voltage is applied to said cleaning member when a region of said intermediary transfer member, which passed through the transfer portion when the first transfer voltage was applied to said transfer member during passing of the recording material through the transfer portion, passes through the cleaning portion, and the second cleaning voltage is applied to said cleaning member when a region of said intermediary transfer member, which passed through the transfer portion when the second transfer voltage was applied to said transfer member during passing of the recording material through the transfer portion, passes through the cleaning portion.

2. An image forming apparatus according to claim 1, wherein said setting portion sets the absolute value of the transfer voltage applied during passing of a first position of the recording material through the transfer portion with respect to the recording material feeding direction so as to be lower than the absolute value of the transfer voltage applied during passing of a second position of the recording material, downstream of the first position with respect to the recording material feeding direction.

3. An image forming apparatus according to claim 2, wherein said setting portion stepwise lowers the absolute value of the transfer voltage.

4. An image forming apparatus according to claim 2 wherein said setting portion continuously lowers the absolute value of the transfer voltage.

5. An image forming apparatus according to claim 1, further comprising an inputting portion into which information on the recording material is inputtable, wherein said setting portion sets, on the basis of the information inputted into said inputting portion, an amount in which the absolute value of the transfer voltage in the operation in the lowering mode is lowered.

6. An image forming apparatus according to claim 5, wherein said setting portion sets, on the basis of the information inputted into said inputting portion, an amount in which the absolute value of the cleaning voltage in the operation in the lowering mode is lowered.

7. An image forming apparatus according to claim 1, further comprising an inputting portion into which information on a lowering level in the operation in the lowering mode is inputtable, wherein said setting portion sets, on the basis of the information inputted into said inputting portion, an amount in which the absolute value of the transfer voltage in the operation in the lowering mode is lowered.

8. An image forming apparatus according to claim 7, wherein said setting portion sets, on the basis of the information inputted into said inputting portion, an amount in which the absolute value of the cleaning voltage in the operation in the lowering mode is lowered.

9. An image forming apparatus according to claim 1, further comprising an inputting portion into which information on the predetermined distance is inputtable, wherein said setting portion sets, on the basis of the information inputted into said inputting portion, the predetermined distance in the operation in the lowering mode.

10. An image forming apparatus according to claim 1, further comprising an inputting portion into which information on a lowering level in the operation in the lowering mode and information on the predetermined distance are inputtable, wherein said setting portion sets, on the basis of the pieces of information inputted into said inputting portion, the absolute value of the transfer voltage in the operation in the lowering mode and the predetermined distance.

11. An image forming apparatus according to claim 1, further comprising an inputting portion into which information on enabling or disabling of execution of the operation in the lowering mode is inputtable, wherein said executing portion determines the enabling or disabling of execution of the operation in the lowering mode on the basis of information inputted into said inputting portion.

* * * * *